US012442617B2

(12) United States Patent
Faecher

(10) Patent No.: US 12,442,617 B2
(45) Date of Patent: Oct. 14, 2025

(54) TOY PROJECTILE LAUNCHER WITH OVER ARM LEVER COCKING MECHANISM

(71) Applicant: Buzz Bee Toys, Inc., Mt. Laurel, NJ (US)

(72) Inventor: Bradley S. Faecher, Sudbury, MA (US)

(73) Assignee: Buzz Bee Toys, Inc., Mt. Laurel, NJ (US)

( * ) Notice: Subject to any disclaimer, the term of this patent is extended or adjusted under 35 U.S.C. 154(b) by 0 days.

(21) Appl. No.: 18/499,322

(22) Filed: Nov. 1, 2023

(65) Prior Publication Data

US 2024/0151491 A1 May 9, 2024

Related U.S. Application Data

(60) Provisional application No. 63/422,485, filed on Nov. 4, 2022.

(51) Int. Cl.
*F41B 11/647* (2013.01)
*F41B 11/54* (2013.01)

(52) U.S. Cl.
CPC ..... *F41B 11/647* (2013.01); *F41B 11/54* (2013.01)

(58) Field of Classification Search
CPC ..... F41B 11/647; F41B 11/54; F41B 11/00; F41B 11/64; F41B 7/08; F41B 7/00; A63B 69/407
See application file for complete search history.

(56) References Cited

U.S. PATENT DOCUMENTS

| | | | | | |
|---|---|---|---|---|---|
| 4,732,136 | A * | 3/1988 | Ferri | F41B 11/55 | 124/67 |
| 4,844,046 | A * | 7/1989 | Straub | F41B 11/647 | 124/80 |
| 5,535,729 | A * | 7/1996 | Griffin | F41B 11/64 | 124/66 |
| 5,660,159 | A * | 8/1997 | Clayton | F41B 11/646 | 124/66 |
| 10,197,355 | B2 * | 2/2019 | Lamboy | F41B 11/683 | |
| 11,118,858 | B1 * | 9/2021 | Harrison | F41B 11/643 | |
| 12,025,403 | B2 * | 7/2024 | Chia | F41B 7/08 | |
| 2012/0080019 | A1 * | 4/2012 | Victor | F41B 7/003 | 124/16 |
| 2023/0136137 | A1 * | 5/2023 | Chia | F41B 11/646 | 124/16 |
| 2023/0296337 | A1 * | 9/2023 | Chia | F41A 9/38 | 124/71 |

* cited by examiner

*Primary Examiner* — Benjamin P Lee
(74) *Attorney, Agent, or Firm* — Volpe Koenig

(57) ABSTRACT

A toy launcher with a housing and a toy projectile holder thereon. A lever arm extends outside the housing and is connected for pivoting movement relative thereto. A piston and cylinder arrangement is located in the housing, with the piston being resiliently biased toward a first end of the cylinder and being moveable toward a second end thereof to a cocked position by the lever arm being pivoted from a first position to a second position. The cylinder is configured to deliver compressed air to the toy projectile holder. A releasable piston catch holds the piston in the cocked position, and is releasable by the trigger or movement of the lever arm itself such that the piston is driven by the biasing element toward the first end of the cylinder to deliver compressed air to the toy projectile holder for launching. The toy projectile can be a foam dart.

16 Claims, 11 Drawing Sheets

TOY PROJECTILE LAUNCHER WITH OVER ARM LEVER COCKING MECHANISM

CROSS-REFERENCE TO RELATED APPLICATIONS

This application claims the benefit of U.S. Provisional Application No. 63/422,485, filed Nov. 4, 2022, which is incorporated herein by reference as if fully set forth.

FIELD OF INVENTION

The disclosure relates to a toy projectile launcher, such as a toy dart launcher, that is easier for younger users to operate, as well as provides a faster more rapid-fire launcher with improved performance for all users.

BACKGROUND

Toy launchers that discharge soft projectiles, such as toy foam darts or toy foam balls, commonly referred to as toy "launchers" are known. The toy projectiles are designed to safely impact upon a target without causing injury or damage. Toy foam darts are known that include a hollow foam body that is connected to a soft polymeric or rubber tip.

Toy launchers may use one of various different mechanisms for launching the projectiles. One known mechanism for launching toy projectiles from a toy launcher involves the application of compressed air on the projectiles to launch them. This can be generated by a user "cocking" the toy projectile launcher by sliding a forearm grip back toward the trigger/handle, drawing back a piston and compressing a spring that is held in a cocked position. When the trigger is pulled, the spring drives the piston forward in a cylinder to generate compressed air that is directed to the back of the toy projectile in order to launch the projectile. However, a drawback of this mechanism is that younger users may not have the strength to easily operate the sliding forearm grip to cock the toy projectile launcher Another known mechanism to launch toy projectiles is to feed the toy projectiles using a pusher mechanism into contact one or more rotating wheels to propel the projectiles forward toward a target. However, these require batteries to operate.

What is needed is an improved toy launcher that is easily operated by younger users without the need for batteries.

SUMMARY

In one aspect, the present disclosure is directed to a toy launcher for launching projectiles, such as soft-tipped foam darts, balls or discs. The toy launcher includes a housing as well as a toy projectile holder on or connected to the housing. A lever arm extends outside of the housing and is connected for pivoting movement relative to the housing. A trigger is also mounted for movement relative to the housing. A piston and cylinder arrangement is located in the housing, with the piston being resiliently biased toward a first end of the cylinder by a biasing element, and the piston being moveable toward a second end of the cylinder to a cocked position by the lever arm being pivoted relative to the housing from a first position to a second position. The cylinder includes a compressed air delivery opening at or connected to the first end that is configured to deliver compressed air from the cylinder to the toy projectile holder. A releasable piston catch is provided that is configured to hold the piston in the cocked position, and the releasable piston catch is releasable upon the trigger being pulled such that the piston that is held in the cocked position is driven by the biasing element toward the first end of the cylinder to deliver compressed air via the air delivery opening to the toy projectile holder that is adapted to launch a toy projectile located in the toy projectile holder. In a preferred embodiment, the toy projectile is a foam dart and the compressed air is delivered into a hollow chamber in the back of the foam dart.

In one embodiment, a drive arm is provided having a first end pivotally connected to the lever arm and a second end connected to a piston stem that extends from the piston.

Preferably, the piston stem includes a longitudinally extending slot, and the second end of the drive arm is configured to engage against an end of the slot as the piston is moved toward the second end of the cylinder to the cocked position by the lever arm being pivoted relative to the housing from the first position to the second position.

Additionally, the second end of the drive arm is preferably movable in the slot as the lever arm is pivoted relative to the housing from the second position back to the first position after the piston is moved to the cocked position.

In another aspect, the releasable piston catch is preferably configured to engage behind a ramp-shaped catch on the piston stem.

Preferably, the releasable piston catch is biased by an elastic element toward an engaged position toward the piston stem, and the ramp-shaped catch on the piston stem resiliently displaces the releasable piston catch as the piston is moved toward the second end of the cylinder to the cocked position by the lever arm being pivoted relative to the housing from the first position to the second position.

In one embodiment, the trigger may include a trigger ramp that is configured to displace the releasable piston catch against a force of the elastic element to a launching position in which the ramp-shaped catch on the piston stem is released upon the trigger being pulled such that the piston that is held in the cocked position is driven by the biasing element toward the first end of the cylinder. However, other means for releasing the releasable piston catch may be provided.

In one preferred arrangement, an optional a lever arm safety catch is movably mounted to the housing and is biased toward the piston stem, preferably by a safety spring. Here, the piston stem further includes a safety recess in which the lever arm safety catch engages when the piston is in the cocked position and the lever arm is not returned to the first position, preferably a forwardmost position where the lever arm lies against the housing. A lever arm safety release is connected to the second end of the drive arm which is configured to release the lever arm safety catch from the safety recess when the lever arm is returned to the first position. The lever arm safety release can be ramp-shaped and engage against and lift the lever arm safety catch out of the safety recess against the resilient force of the spring.

Here, the piston stem is still held in the cocked position by the releasable piston catch in a normal firing mode, waiting for the trigger to be pulled to launch the toy projectile. In a "slam" firing mode in which a user holds the trigger while activating the lever arm, the lever arm safety release acting against the lever arm safety catch as the lever arm is returned to the first position releases the piston from the cocked position to launch the toy projectile.

In another aspect, the toy projectile holder may be formed as a rotatable drum having a plurality of toy projectile receiving spaces. In this case, an indexing mechanism is connected to the rotatable drum to advance the rotatable drum to a next receiving space as the lever arm is pivoted relative to the housing from the first position to the second position.

In a preferred embodiment, the rotatable drum optionally includes an indexing spool with a plurality of circumferentially spaced apart indexing drive surfaces, and the indexing mechanism includes a slidable indexing cam that is releasably engageable with an indexing drive projection on the piston stem such that as the lever arm is pivoted relative to the housing from the first position to the second position, the indexing cam is disengaged from a current one of the indexing drive surfaces, and upon the piston stem reaching a release position, the indexing cam is biased back into engagement with a next one of the indexing drive surfaces. Here there may be first and second axially spaced-apart indexing spools, and the indexing cam can include drive cam surfaces at each end such that the rotatable drum is partially advanced as the indexing cam is drawn back in a first direction and engages a drive surface of the second indexing spool, and then completes the advance of the rotatable drum to the next projectile receiving space into the launch position as the indexing cam is biased back into engagement with a next one of the indexing drive surfaces on the first indexing spool.

In this arrangement if the lever arm safety catch and the lever arm safety release are provided in connection with the rotatable drum and indexing spool, in the "slam" firing mode where the trigger is held as the lever is repeatedly moved between the first and second positions, the toy projectile in a projectile receiving space that is aligned with the delivery opening is launched and the rotatable drum is indexed to the next toy projectile in the next toy projectile receiving space to provide rapid fire operation.

In a preferred embodiment, the trigger is linearly moveable. However, it could instead be pivotable.

Using one or more of the above features in connection with the lever arm for cocking the piston allows the present toy projectile launcher to be operated by younger users or users with less strength than the previously known toy projectile launchers, without the need for batteries.

Further, operating the present toy projectile launcher can also be done in a "rapid fire" manner in which the trigger is held in a launch position by the user, and then operating the lever arm only by pivoting it between the first and second positions results in successive toy projectiles being launched with each movement cycle of the lever arm.

In another aspect, the present disclosure is directed to a further embodiment of toy launcher for launching projectiles that allows for simplified operation. Here, the toy launcher includes a housing with a toy projectile holder on or connected to the housing. A lever arm extends outside of the housing and is connected for pivoting movement relative to the housing. A piston and cylinder arrangement is located in the housing, with the piston being resiliently biased toward a first end of the cylinder by a biasing element. The piston is moveable toward a second end of the cylinder to a cocked position by the lever arm being pivoted relative to the housing from a first position to a second position. The cylinder includes a compressed air delivery opening at or connected to the first end that is configured to deliver compressed air from the cylinder to the toy projectile holder. A releasable piston catch is driven by the lever arm and is configured to draw the piston to the cocked position, and the releasable piston catch is releasable upon or after the lever arm being pulled to the second position such that the piston is released and is driven by the biasing element toward the first end of the cylinder to deliver compressed air via the air delivery opening to the toy projectile holder that is adapted to launch a toy projectile located in the toy projectile holder. This arrangement provides simplified operation as no trigger is needed, and the toy projectile is automatically launched when the lever arm is pivoted to the second position.

In one arrangement, the toy launcher can include a drive arm having a first end pivotally connected to the lever arm and a second end to which the releasable piston catch is connected. Preferably, the releasable piston catch is pivotally mounted to the second end of the drive arm and is biased into engagement with a catch on a piston stem that extends from the piston.

In one embodiment, a release projection is connected to the housing of the toy projectile launcher and is arranged to contact the releasable piston catch as the lever arm is moved to the second position to pivot the releasable piston catch out of engagement with the catch on the piston stem such that the piston is released.

In one preferred arrangement, the toy projectile holder includes a rotatable drum having a plurality of toy projectile receiving spaces, and an indexing mechanism is connected to the rotatable drum to advance the rotatable drum to a next receiving space as the lever arm is pivoted relative to the housing from the first position to the second position.

While a rotatable drum is one possibility for providing multiple toy projectiles, other types of magazines could be used.

In a preferred embodiment, the rotatable drum includes an indexing spool with a plurality of circumferentially spaced apart indexing drive surfaces, and the indexing mechanism includes a slidable indexing cam that is releasably engageable with an indexing drive projection on the piston stem such that as the lever arm is pivoted relative to the housing from the first position to the second position, the indexing cam is disengaged from a current one of the indexing drive surfaces, and upon the piston stem reaching a release position, the indexing cam is biased back into engagement with a next one of the drive surfaces.

It is noted that various ones of the above-noted features can be used alone or in combination with one another.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION

Figure 1:
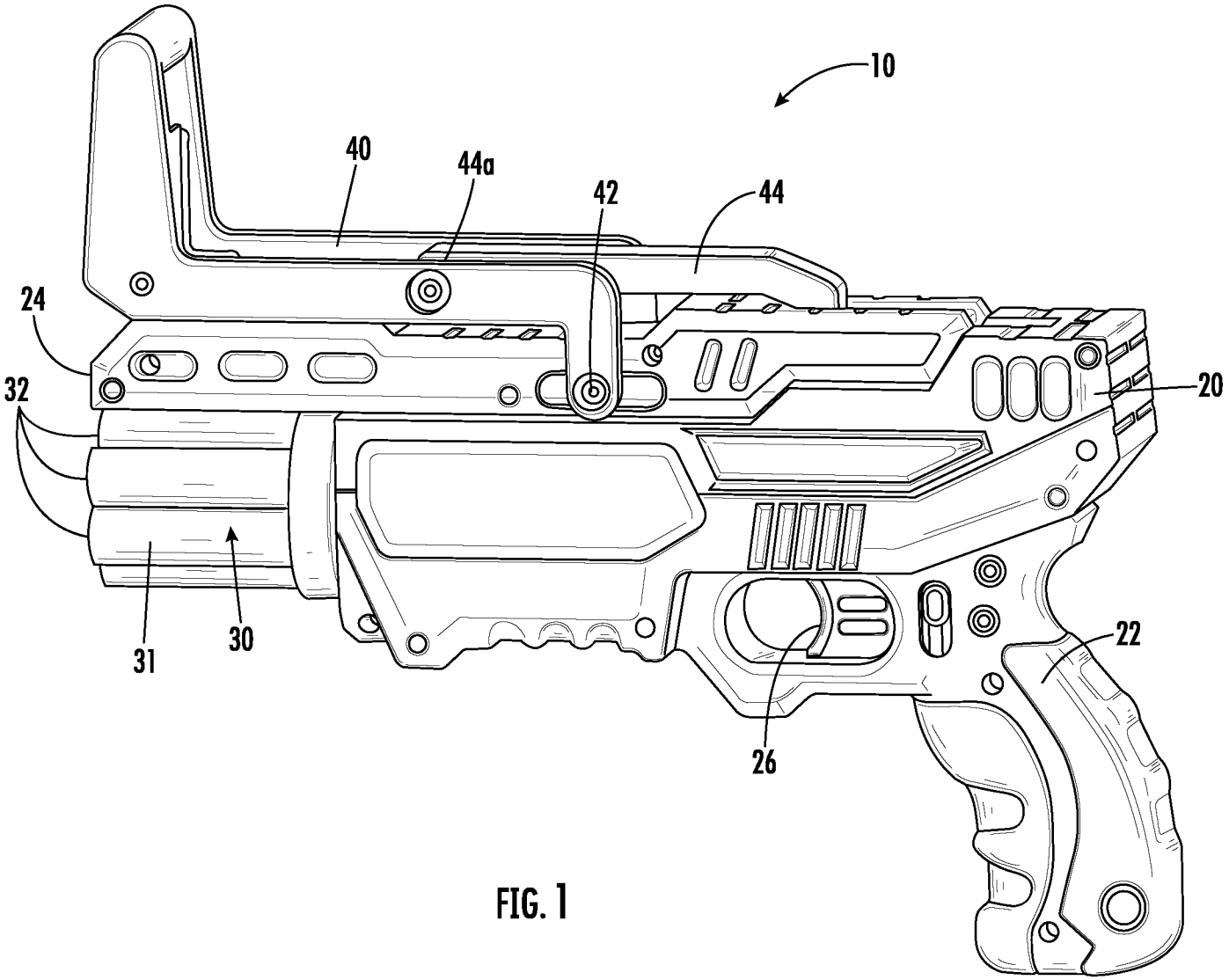
FIG. 1 is a left side elevational view of a toy projectile launcher for launching toy projectiles, such as foam darts, and includes a lever arm that extends outside of the housing for cocking the toy launcher.

Certain terminology is used in the following description for convenience only and is not limiting. The words "inwardly" and "outwardly" refer to directions toward and away from the parts referenced in the drawings. A reference to a list of items that are cited as, for example, "at least one of a or b" (where a and b represent the items being listed) means any single one of the items a or b, or a combination of a and b thereof. This would also apply to lists of three or more items in like manner so that individual ones of the items or combinations thereof are included. The terms "about" and "approximately" encompass + or −10% of an indicated value unless otherwise noted. The term "generally" in connection with a radial direction encompasses +/−25 degrees. The terminology includes the words specifically noted above, derivatives thereof and words of similar import.

Figure 2:
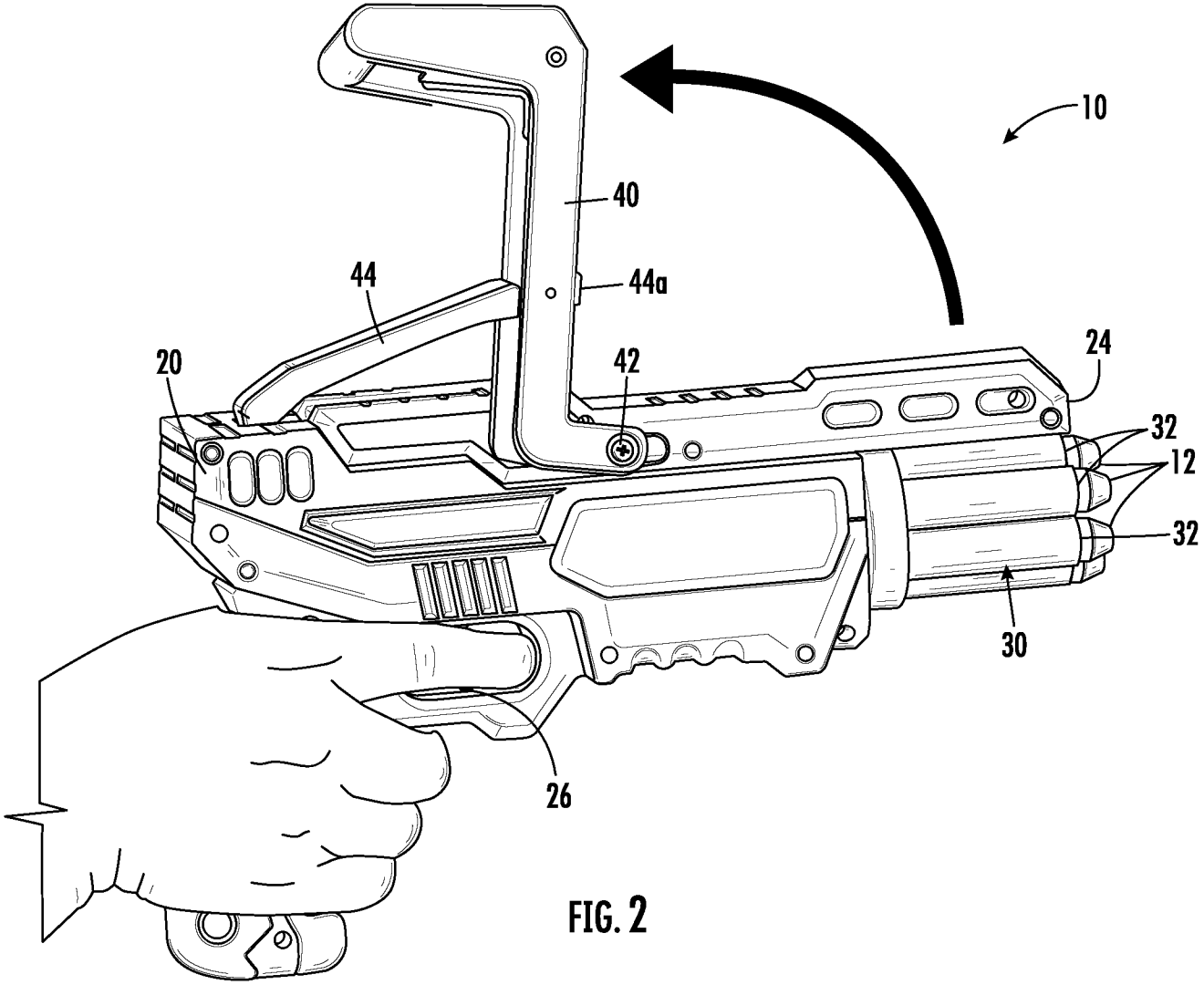
FIG. 2 is a right side elevational view of the toy projectile launcher shown in FIG. 1 with the lever arm shown in the cocking position. Additionally, foam darts are shown in the projectile receiving areas in a rotatable drum at the discharge end of the toy launcher.

Referring to FIGS. 1-6, a toy launcher 10 for launching projectiles 12, which can be for example toy foam darts or foam balls, is shown. In the preferred embodiment, the toy projectiles 12 are foam darts as shown in FIG. 2. These are of the generally known type that have a hollow cylindrical foam body and a elastomeric tip.

The toy launcher 10 includes a housing 20 that has a grip/handle 22 at the proximal end that can be gripped by a user. The housing 20 is preferably formed from molded polymeric material generally in two halves. The left half of the housing is shown removed in FIGS. 3 and 4. A toy projectile holder 30 is located on or connected to the housing 20 at the discharge end 24, opposite from the grip/handle 22. The toy projectile holder 30 may be formed as a rotatable drum 31 having a plurality of toy projectile receiving spaces 32 as shown for example in FIGS. 2-5. Alternatively, it could be a single receiving space 32.

As shown in FIGS. 1-4, a lever arm 40 extends outside of the housing 20 and is connected for pivoting movement at a pivot connection 42 in order to allow pivoting movement relative to the housing 20.

A trigger 26 is mounted for movement relative to the housing 20 and can be used to activate the toy projectile launcher 10 in order to launch toy projectiles 12 once the lever arm 40 is cocked.

Figure 3:
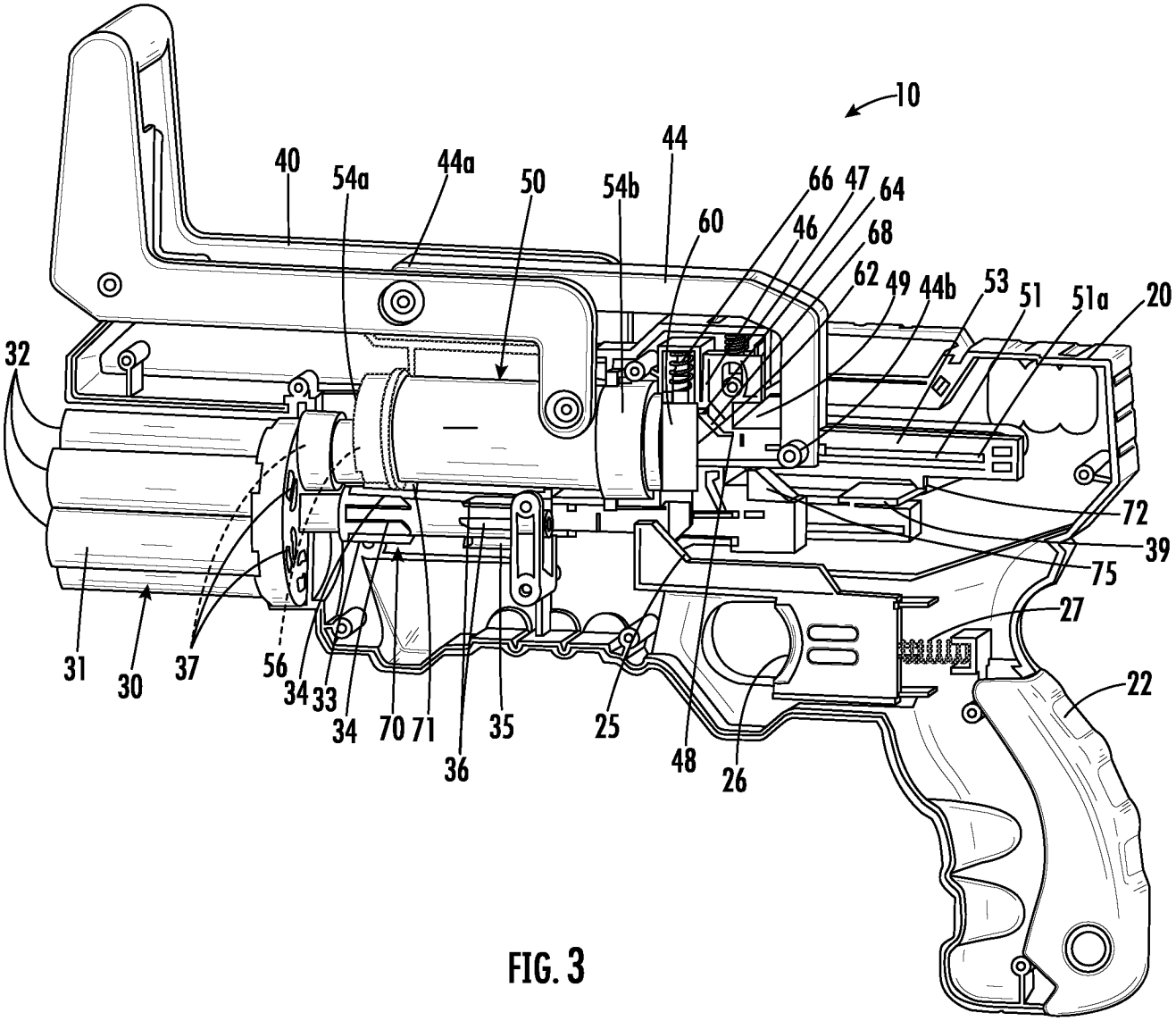
FIG. 3 is a left side elevational view of the toy launcher shown in FIGS. 1 and 2 with the left side portion of the housing removed in order to show the internal components of the toy launcher.
Figure 4:
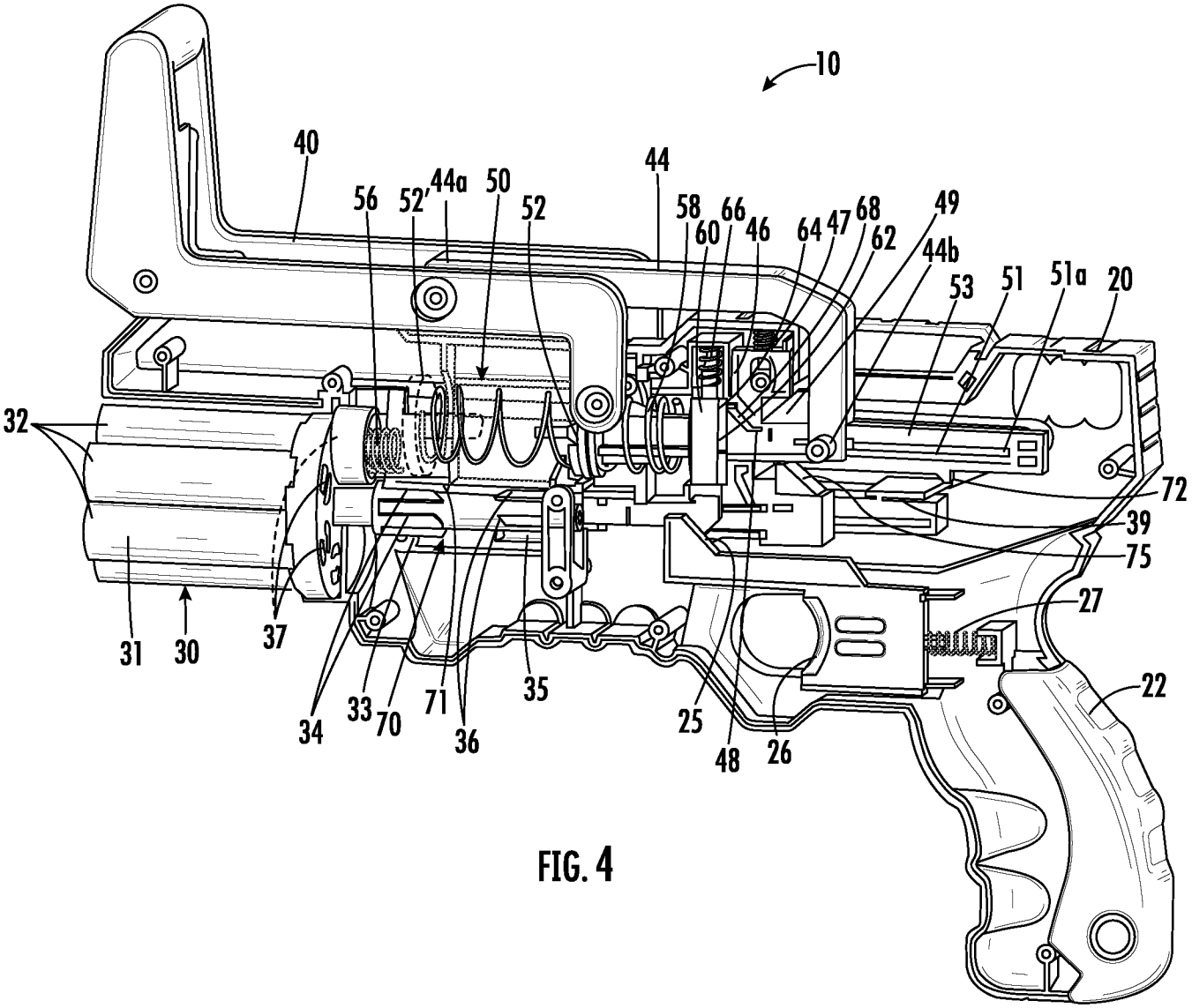
FIG. 4 is a view similar to FIG. 3 in which the cylinder surrounding the piston is removed in order to further show the inner components of the toy launcher.
Figure 5:
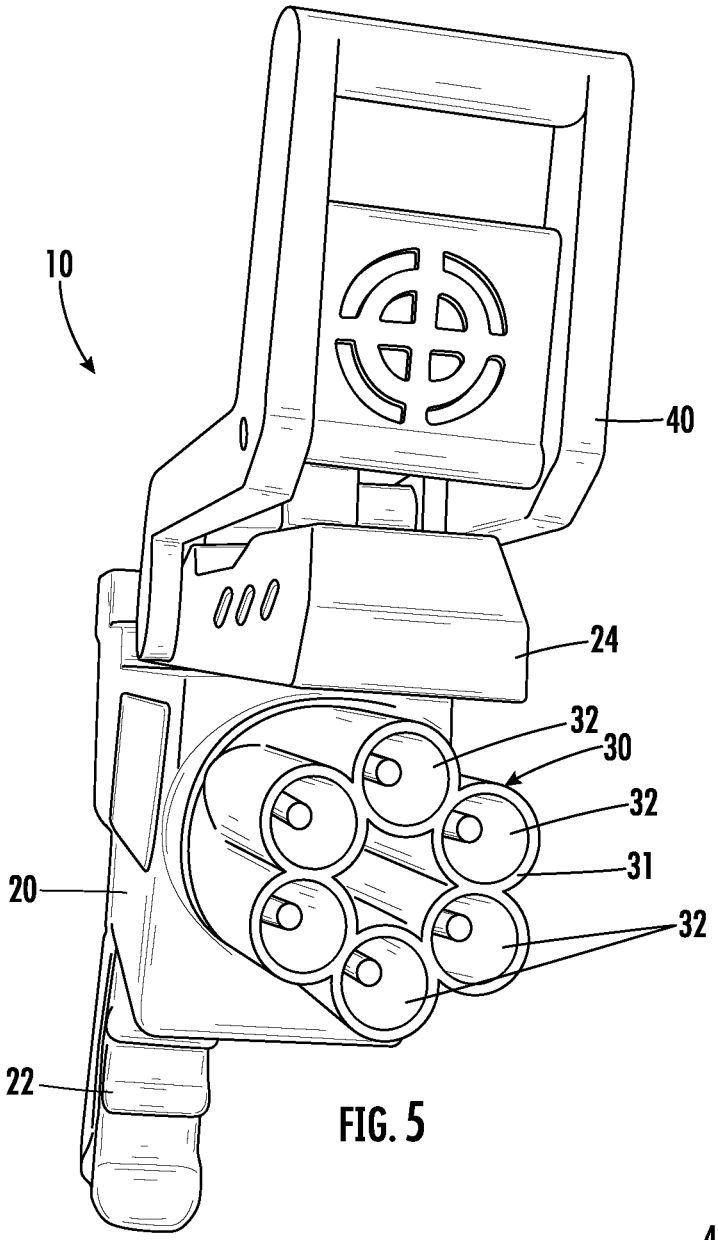
FIG. 5 is a front view of the toy launcher showing the rotatable drum that includes the plurality of toy projectile receiving spaces without the toy projectiles, which in the illustrated embodiment are foam darts, inserted in the toy receiving spaces.
Figure 6:
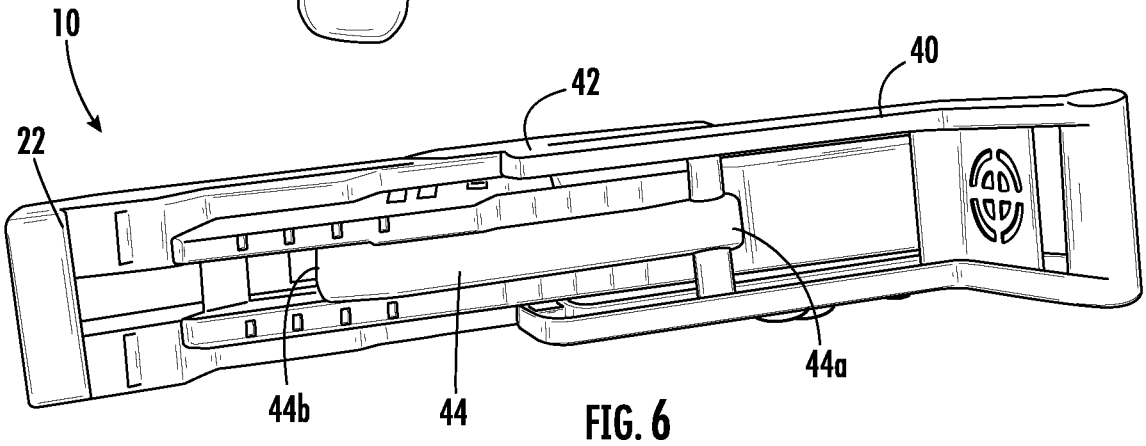
FIG. 6 is a top view showing the lever arm that extends outside of the housing as well as the drive arm that is pivotally connected to the lever arm that extends into the housing to the piston stem.

A piston and cylinder arrangement 50 is located in the housing 20 as shown in detail in FIGS. 3 and 4. The piston and cylinder arrangement 50 includes a piston 52 that is resiliently biased toward a first end 54*a* of a cylinder 54 by a biasing element 58, shown as a helical spring in FIG. 4 (note that the spring is shown in the extended position with the piston indicated in broken lines as 52' at the first end 54*a* of the cylinder 54). However, other types of biasing elements such as an air cylinder could also be used. The piston 52 is moveable toward a second end 54*b* of the cylinder 54 to a cocked position by the lever arm 40 being pivoting relative to the housing 20 from a first position, shown in FIG. 1, to a second position, as shown in FIG. 2. The piston 52 is shown with solid lines in the cocked position in FIG. 4.

Referring again to FIGS. 3 and 4, the cylinder 54 includes a compressed air delivery opening 56 that is at or connected to the first end 54*a* and is configured to deliver compressed air from the cylinder 54 to the toy projectile holder 30, and more specifically to an aligned opening 37 or one of the openings 37 located at a rear side of the toy projectile holder 30.

A releasable piston catch 60 that is configured to hold the piston 52 in the cocked position is located in the housing 20. The releasable piston catch 60 is releasable upon the trigger 26 being pulled such that the piston 52 that is held in the cocked position is driven by the biasing element 58 toward the first end 54*a* of the cylinder 54 to deliver compressed air via the air delivery opening 56 to a rear side of a toy projectile located in the toy projectile holder 30 that is adapted to launch the toy projectile 12.

Still with reference to FIGS. 3 and 4, preferably a drive arm 44 is connected between the lever arm 40 and the piston 52. The drive arm 44 has a first end that is 44*a* that is pivotally connected to the lever arm 40 and a second end 44*b* that is connected to a piston stem 53 that extends from the piston 52. This piston stem 53 includes a longitudinally extending slot 51 and the second end 44*b* of the drive arm 44 is configured to engage against an end 51*a* of the slot 51 to move the piston 52 toward the second end 54*b* of the cylinder 54 to the cocked position by the lever 40 being pivoted relative to the housing 20 from the first position, shown in FIG. 1, to the second position, shown in FIG. 2. The second end 44*b* of the drive arm 44 is movable in the slot 51 as the lever arm 40 is pivoted relative to the housing 20 from the second position, shown in FIG. 2, back to the first position, shown in FIG. 1, after the piston 52 is moved to the cocked position. The releasable piston catch 60 is configured to engage behind a ramp-shaped catch 68 on the piston stem 53 to hold the piston 52 in the cocked position. In the illustrated embodiment, the releasable piston catch 60 includes a hollow body 62 through which the piston stem 53 extends. A stop 64 is formed on the hollow body 62 and, as the piston 52 is drawn back by the lever arm 40 being cocked, the ramp-shaped catch 68 on the piston stem 53 forces the hollow body 62 upwardly against the force of a spring 66 until the hollow body 62 passes the ramp-shaped catch 68 and is biased back downwardly toward the piston stem 53 into a holding position where a front of the ramp-shaped catch 68 contacts the stop 64.

Still with reference to FIGS. 3 and 4, the trigger 26 includes a trigger ramp 25 that, upon the trigger 26 being pulled, is configured to displace the releasable catch 60, and more specifically the hollow body 62, against a force of the spring 66, which could be formed as any type of elastic element, to a launching position in order to move the stop 64 out of engagement with the ramp-shaped catch 68 on the piston stem 52 which is released such that the piston 52 that was held in the cocked position, upon being released, is driven by the biasing element 58 toward the first end 54*a* of the cylinder 54, compressing air within the cylinder and delivering this via the air delivery opening 56 to the toy projectile holder 30. This is preferably delivered into the receiving opening 37 of the rotatable drum 31 that is aligned with the air delivery opening 56 in order to deliver compressed air to a rear side of the toy projectile 12, such as a foam dart, that is held in the toy projectile receiving space 32.

As shown in FIGS. 3 and 4, and more clearly in the sequence of FIGS. 7-11, the toy launcher preferably includes a lever arm safety catch 46 movably mounted to the housing 20 that is biased toward the piston stem 53, preferably using a spring 47, and the piston stem 53 further comprises a safety recess 48 in which the lever arm safety catch 46 engages when the piston 52 is in the cocked position and the lever arm 40 is not returned to the first position. See FIG. 9 for the engaged position. A lever arm safety release 49 is connected to the second end 44*b* of the drive arm 44 which is configured to release the lever arm safety catch 46 from the safety recess 48 when the lever arm 40 is returned to the first position. Compare FIGS. 9 and 10. The lever arm safety catch 46 therefore prevents firing even if the trigger 26 is pulled if the layer arm 40 is not returned to the first position, shown in FIGS. 7, 10, and 11 which would prevent the drive arm 44 from flipping the lever arm 40 forward if the trigger 26 is pulled before the lever arm is returned to the first position.

In the preferred embodiment, where multiple toy projectiles 12 can be loaded into the toy projectile holder 30 that is formed as the rotatable drum 31, an indexing mechanism 70 is connected to the rotatable drum 31 to advance the rotatable drum 31 to a next receiving space 32 as the lever arm 40 is pivoted relative to the housing 20 from the first position, shown in FIG. 1, to the second position, shown in FIG. 2.

As shown in detail in FIGS. 2 and 3, the rotatable drum 31 preferably includes a first indexing spool 30 that includes a plurality of circumferentially spaced apart indexing drive surfaces 34. The indexing mechanism 70 further includes a slidable indexing cam 71 that is releasably engageable with an indexing drive projection 72 on the piston stem 53 such that as the lever arm 40 is pivoted relative to the housing 20 from the first position to the second position, the indexing cam 71 is disengaged from a current one of the indexing drive surfaces 34 in the first indexing spool 33, and upon the piston stem 53 reaching a release position, the indexing cam 71 is biased back into engagement with a next one of the indexing drive surfaces 34. The release position in this case can be defined by a ramp surface 39 on the housing 20 that forces an indexing catch 75 (that is connected to the indexing cam 71) downwardly as the piston 52 is continued to be moved toward the cocking position such that it releases and allows the indexing cam 71 to be biased back into engagement with a next one of the indexing drive surfaces 34. The indexing catch 75 is preferably spring biased toward the engaged position.

In the illustrated embodiment, an optional second indexing spool 35 is located axially behind the first indexing spool 33 and the slidable indexing cam 71 engages with an indexing drive surface 36 on the second indexing spool 35 as the slidable indexing cam 71 is drawn backward by movement of the piston 52 via the lever arm 40. This provides two sets of indexing drive surfaces for rotating the rotatable drum 31 in order to ensure positional accuracy and positive drive and positioning of the rotatable drum 31 along the full rotational movement path.

In the preferred embodiment, the trigger 26 is linearly moveable. However, it could also be a pivoting trigger. A trigger spring 27 is also shown which biases the trigger 26 to the ready position.

While the preferred embodiment illustrates the toy projectile holder 30 as a rotatable drum 31, it is also possible to provide a single toy projectile receiver that is fixed in position or to provide other types of projectile holders that index a projectile into a position that aligns the air opening 37, for example shown on the rotatable drum 31 behind each receiving space 32 with the air delivery opening 56 from the cylinder 54. This could be for example a magazine that holds multiple darts that are delivered to the launching position.

Figure 7:
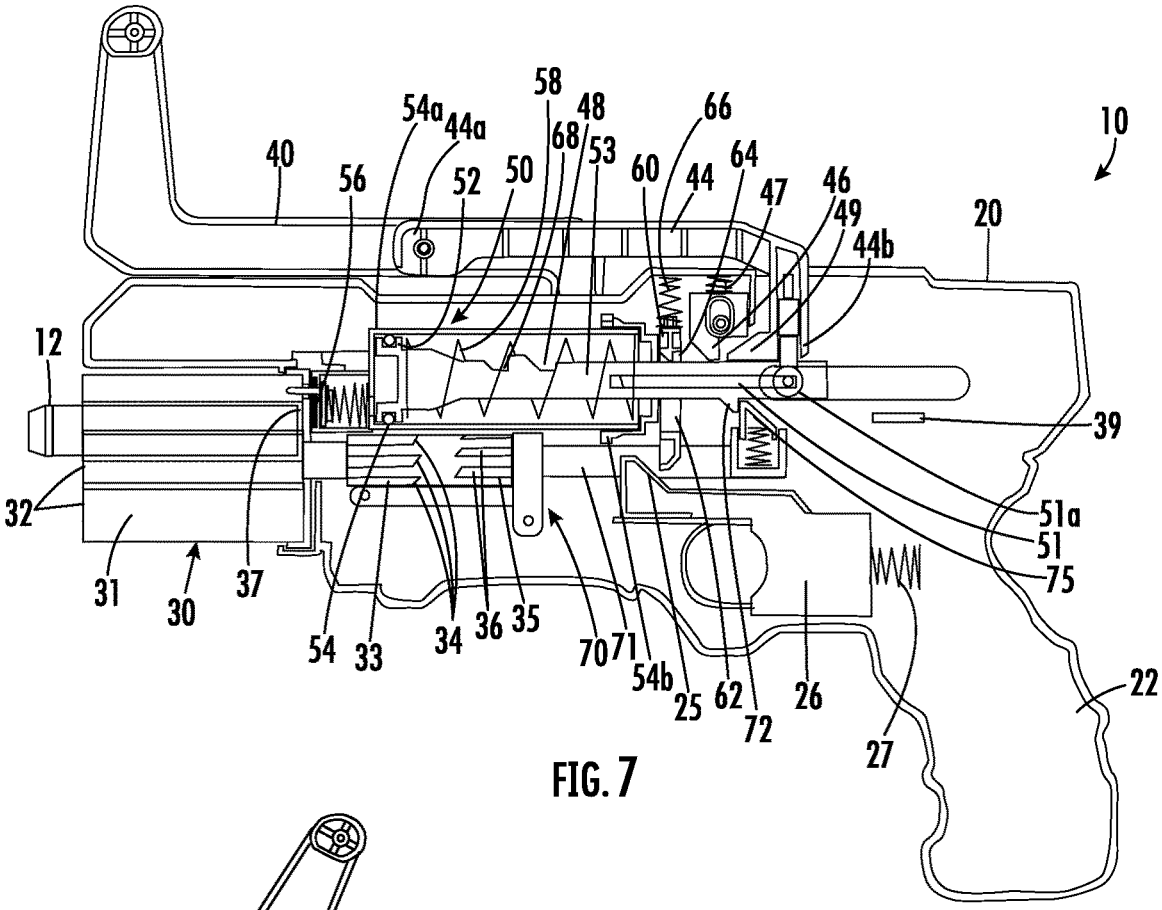
FIGS. 7-11 are a series of views of the toy projectile launcher similar to FIG. 3, with the left side portion of the housing removed in order to show the internal components of the toy launcher, with the piston cylinder being partially removed to show the piston position, in which the cocking and firing of the toy projectile launcher are illustrated.
Figure 8:
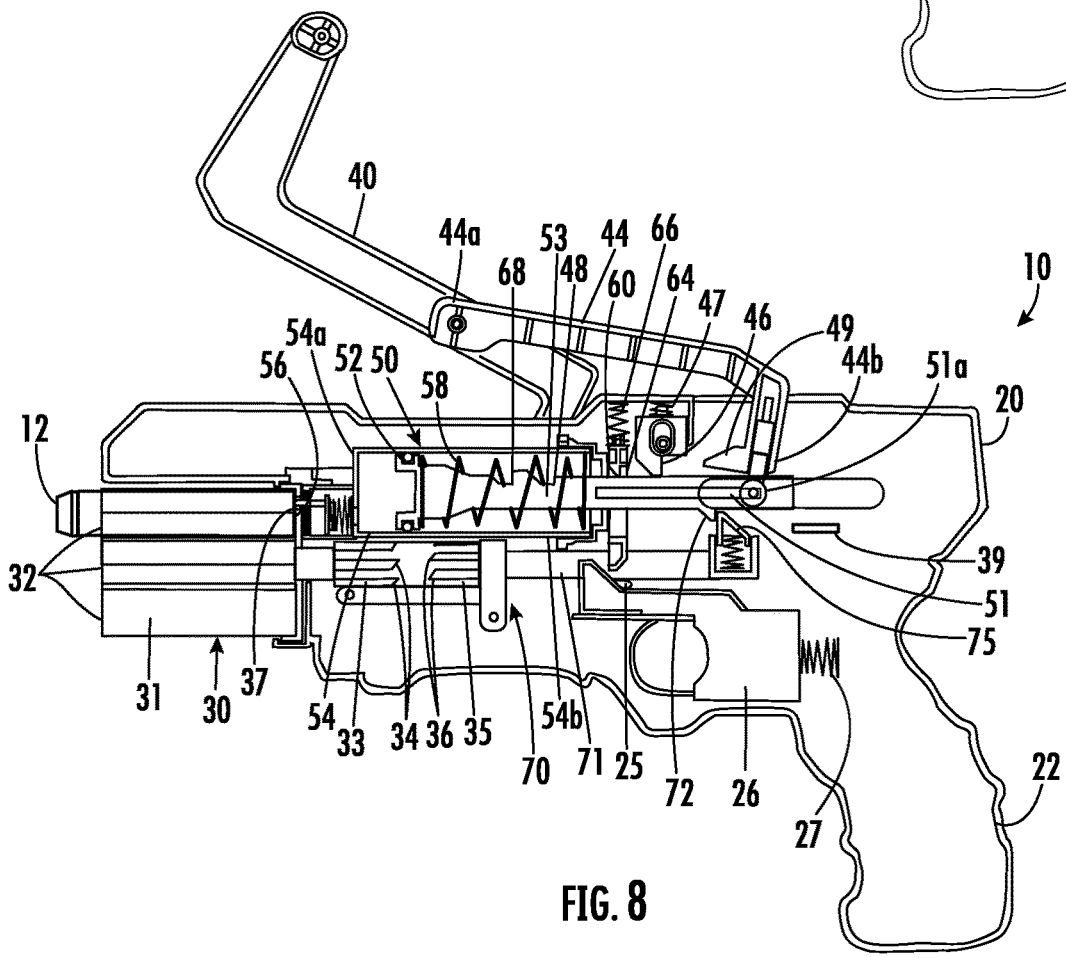

Referring now to FIGS. 7-11, a series of views of the toy launcher 10 are shown to describe a normal launching sequence. In FIG. 7, the lever arm 40 is shown in the first position prior to being pivoted relative to the housing 20 to the second position, as shown in FIG. 8, where the pivoting movement of the lever arm 40 has started. Here, the lever arm 40 moves the drive arm 44 rearwardly such that the second end 44*b* engages against the end 51*a* of the slot 51 in the stem 53 to move the piston 52 toward the second end 54*b* of the cylinder 54 toward the cocked position. Here, it can be seen that the lever arm safety release 49 moves out of contact with the lever arm safety catch 46 such that the spring 47 biases the lever arm safety catch against the piston stem 53.

Figure 9:
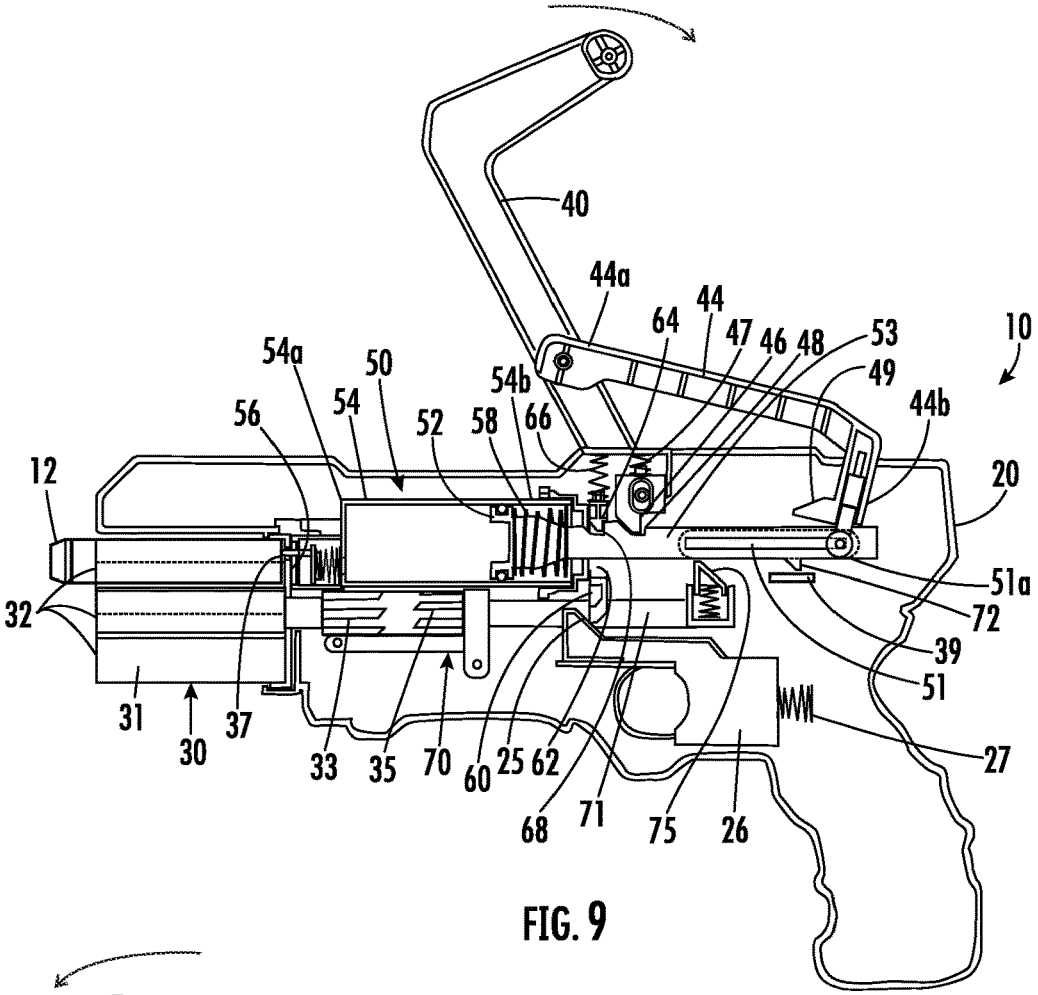

As shown in FIG. 9, when the lever arm 40 reaches the second position, both the lever arm safety catch 46 and the releasable piston catch 60 engage respectively with the safety recess 48 and the ramp-shaped catch 68 on the piston stem 53. Here, the piston 52 with the piston stem 53 are held in the cocked position. Additionally, the slidable indexing cam 71 is drawn backward as the lever arm 40 is moved through the positions shown in FIGS. 7-8 until the indexing catch 75 is released from the indexing drive projection 72 on the piston stem 53 by the ramp surface 39 on the housing 20 contacting the indexing catch 75 so that it is moved downwardly and releases from the indexing drive projection 72 to be release the slidable indexing cam 71 to return to a forward position as shown in FIG. 9, indexing the rotatable drum 31 such that a next receiving space 32 is positioned to receive air from the air delivery opening 56.

Figure 10:
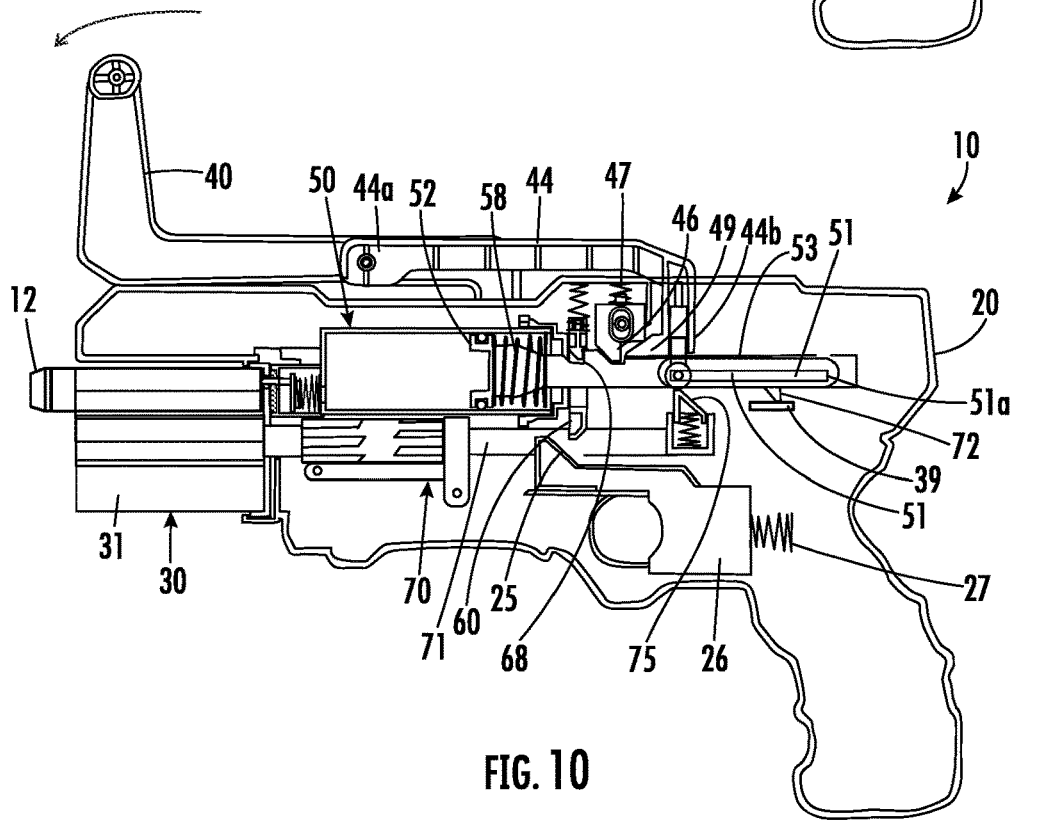

Referring to FIG. 10, as the lever arm 40 is moved back to the first position, the lever arm safety release 49 moves the lever arm safety catch 46 against the force of the spring 47 out of the safety recess 48 so that the toy launcher 10 is ready to fire.

Figure 11:
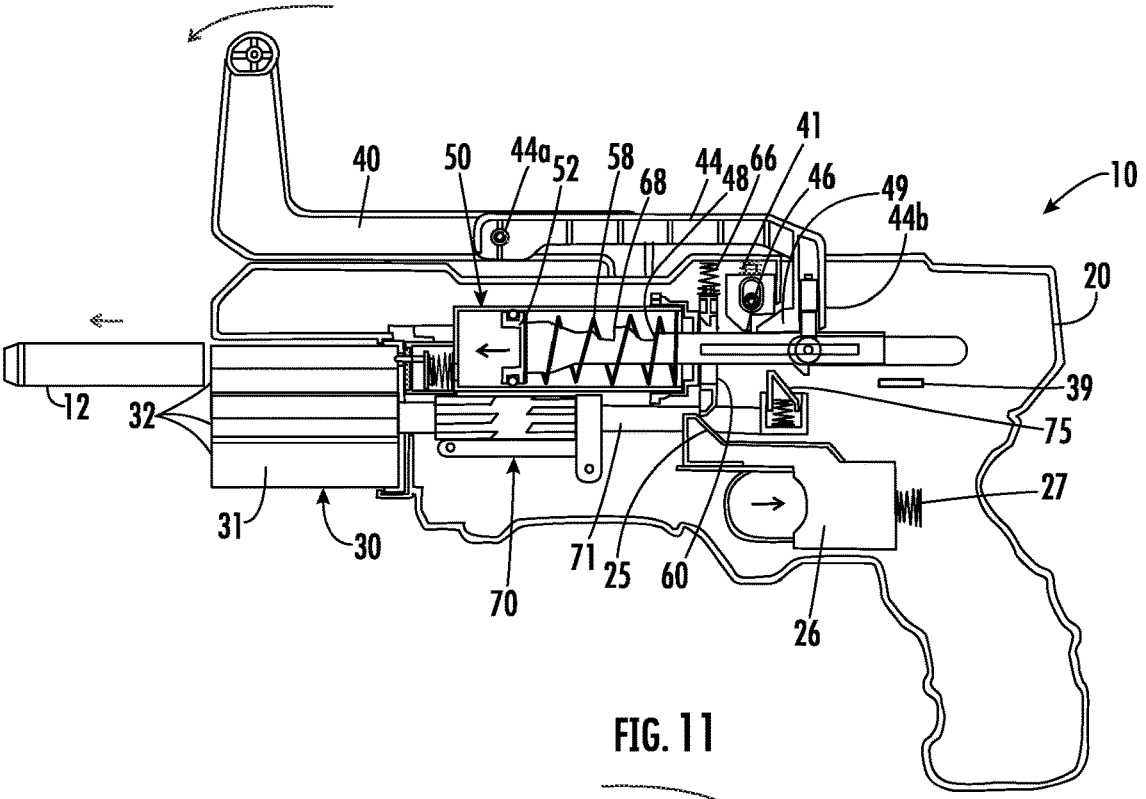

As shown in FIG. 11, as the trigger is pulled, the releasable piston catch 60 is displaced upwardly via the trigger ramp 25 releasing from the ramp-shaped catch 68 on the piston stem 53 such that the piston 52 which was held in the cocked position is driven forward by the biasing element 58 toward the first end 54*a* of the cylinder 54, releasing compressed gas via the delivery opening 56 that is used to launch a toy projectile 12 out of the aligned toy projectile receiving space 32.

Figure 12:
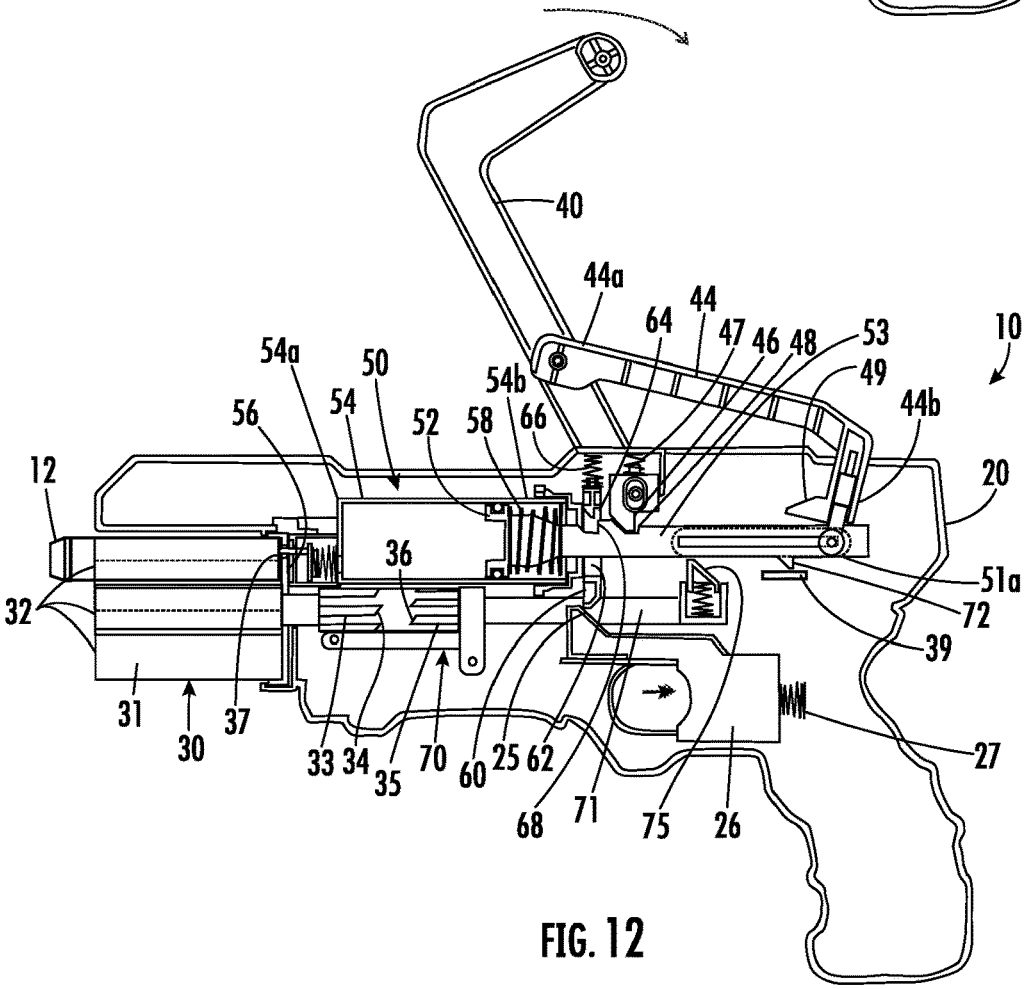
FIGS. 12-13 are views similar to FIGS. 7-11, illustrating the use of the toy projectile launcher in a "slam" firing mode.
Figure 13:
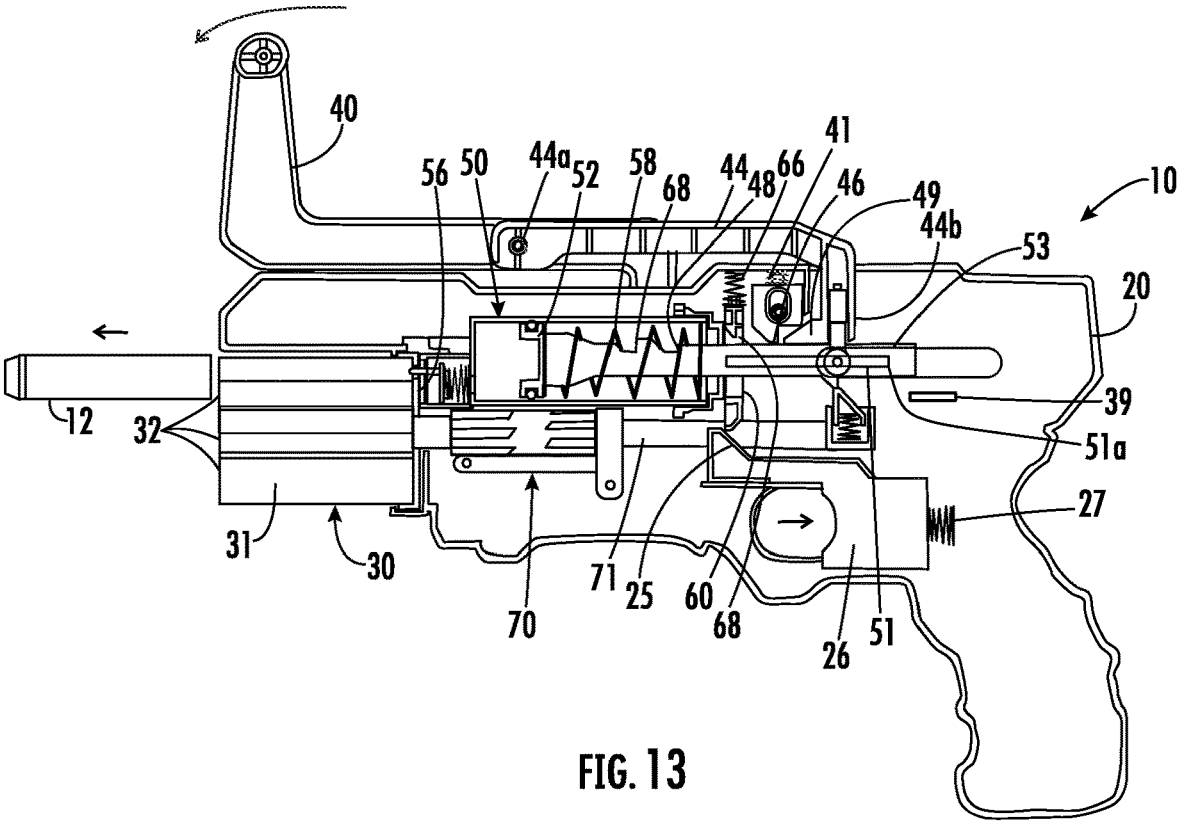

Referring now to FIGS. 12 and 13, this sequence of views illustrates the use of the toy projectile launcher 10 in a "slam" firing mode.

As shown in FIG. 12, the lever arm 40 is moved backward from the first position (such as shown in FIG. 7) to the second position while the trigger 26 is held by the user. Since the trigger 26 is held, the releasable piston catch 60 is held out of engagement with the ramp-shaped catch 68 on the piston stem 53. However, the lever arm safety catch 46 engages in the safety recess 48 on the piston stem 53, as indicated in FIG. 12. The rotatable drum 31 which acts as the toy projectile holder 30 is also indexed via the indexing mechanism 70 as discussed above in connection with FIGS. 7-9.

As shown in FIG. 13, as the lever arm 40 is moved back to the first position after reaching the cocking position, the lever arm safety release 49 which is connected to the second end 44*b* of the drive arm 44 contacts the lever arm safety catch 46 and moves it against the force of the spring 47 out of engagement with the safety recess 48, allowing the piston 52 to be driven forward via the biasing element 58 such that compressed air is delivered via the air delivery opening 56 to the toy projectile holder 30 such that a toy projectile 12 located in the aligned toy projectile receiving space 32 of the toy projectile holder 30 is launched.

Referring now to FIGS. 14-17, the construction as well as a launching sequence of a second embodiment of the toy projectile launcher 110 is shown. In these figures, similar element numbers to the first embodiment of the toy launcher 10 are indicated with a similar element number plus 100 and these features are functionally the same unless otherwise described below. For example, the housing 120 of the toy launcher 110 is similar to the housing 20 as discussed above. The toy launcher 110 is used for launching projectiles 12 can be the same as those discussed above and can be used in a simplified manner which is more conducive to play for younger users.

Figure 14:
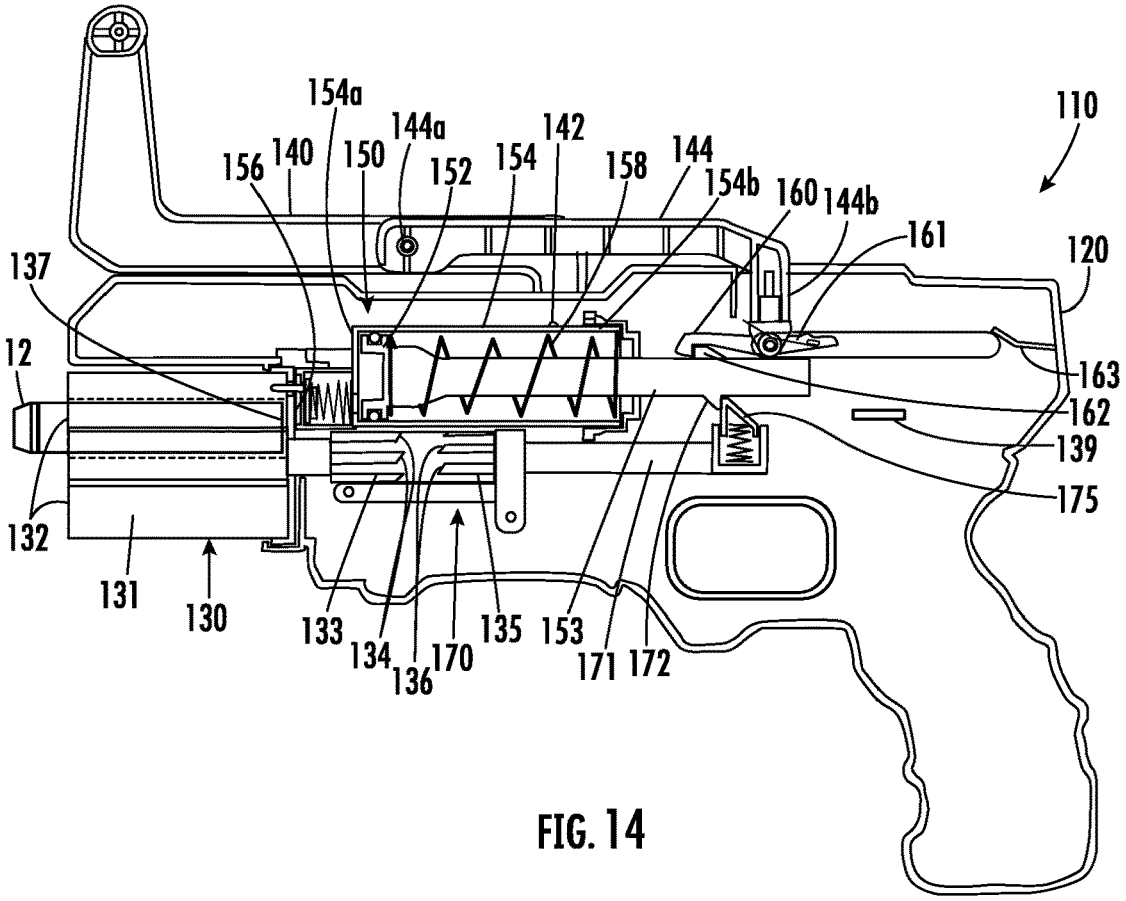
FIGS. 14-17 are a series of views of another embodiment of the toy projectile launcher in which both cocking and firing of the toy projectile launcher to launch a toy projectile are carried out by the lever arm attached to a top of the toy gun housing, with the left side portion of the housing removed in order to show the internal components of the second embodiment of the toy projectile launcher, and with the piston cylinder being partially removed to show the piston position, in which the cocking and firing of the toy projectile launcher are illustrated.

As shown in FIG. 14, the toy launcher 110 includes a housing 120 along with a toy projectile holder 130 connected to the housing 120. The toy projectile holder 130 can be the rotatable drum 131, similar to the rotatable drum 31 discussed above that includes a plurality of toy projectile receiving spaces 132. An indexing mechanism 170 is connected to the rotatable drum 131 to advance the rotatable drum 131 to a next receiving space 132 as the lever arm 140 is pivoted relative to the housing 120 from a first position to a second position, in the same manner as discussed in connection with the toy launcher 10 above. Opening(s) 137 located at a rear side of the toy projectile holder 130.

The toy launcher 110 includes a lever arm 140 that extends outside of the housing 120 and is connected for pivoting movement relative to the housing 120, preferably via a pivot connection 142. A piston and cylinder arrangement 150 is located in the housing 20, with the piston and cylinder arrangement 150 including a piston 152 that is resiliently biased toward a first end 154*a* of a cylinder 154 by a biasing element 158, preferably a spring, and the piston 152 is movable toward a second end 154*b* of the cylinder 154 to a cocked position by the lever arm 140 being pivoted relative to the housing 120 from the first position to the second position. In this embodiment, the first position is shown in FIG. 14 and the second position is shown in FIG. 17.

Figure 17:
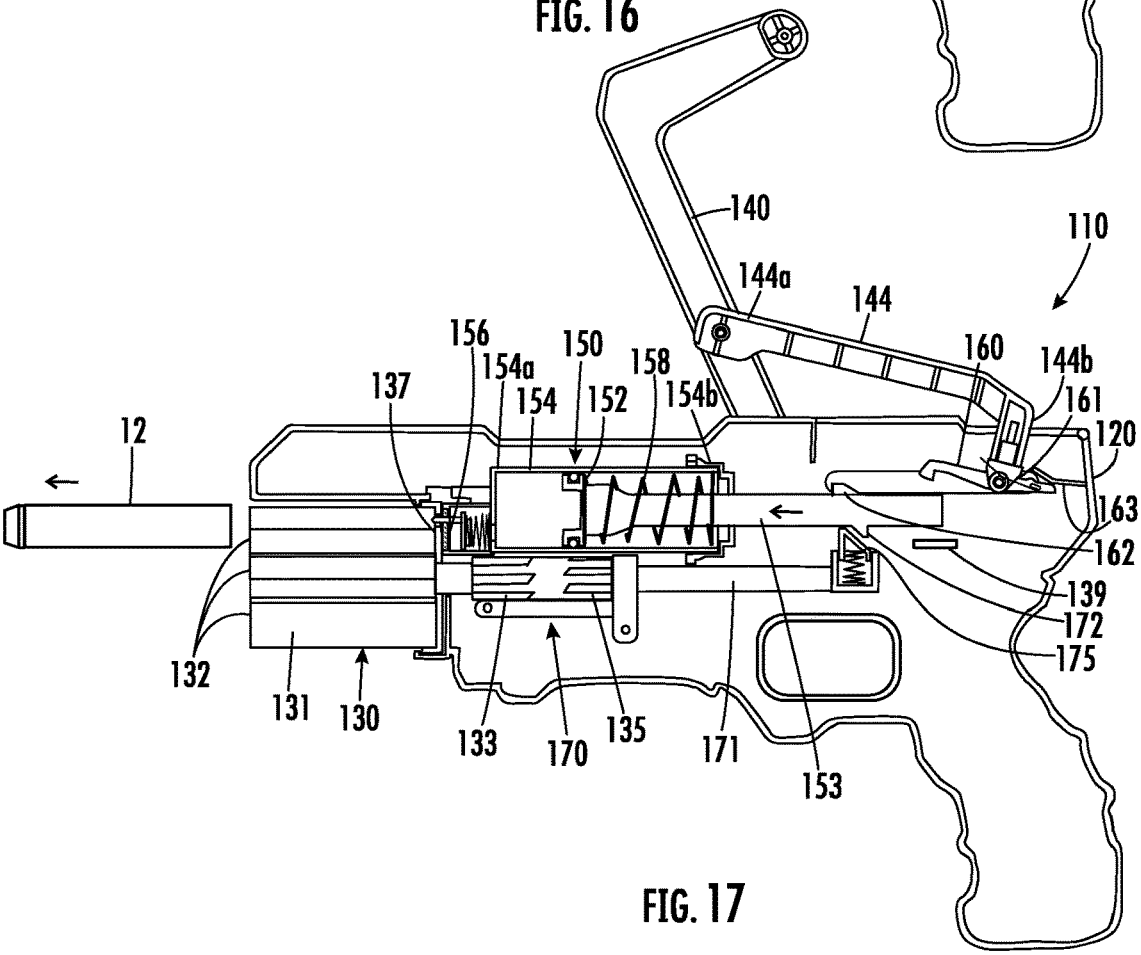

A releasable piston catch 160 that is driven by the lever arm 140 is configured to draw the piston 152 to the cocked position, and the releasable piston catch 160 is releasable upon the lever arm 140 being pulled to the second position, as shown in FIG. 17, or after the lever arm 140 reaches the second position, such as during a return movement to the first position, such that the piston 152 is released and is driven by the biasing element 158 toward the first end 154*a* of the cylinder 154 to deliver compressed air via the air delivery opening 156 and aligned opening 137 in the back of the receiving space 132 of the toy projectile holder 130 that is adapted to launch a toy projectile 12 located in the receiving space 132.

As shown in detail in FIGS. 14-17, a drive arm 144 having a first end 144*a* pivotally connected to the lever arm 140 and a second end 144*b* to which the releasable piston catch 160 is connected is also provided.

The releasable piston catch 160 is preferably pivotally mounted to the second end 144*b* of the drive arm 144 and is biased, preferably via a spring 161, into engagement with a catch 162 on a piston stem 153 that extends from the piston 152.

A release projection 163 is connected to the housing 120 and is arranged to contact the releasable piston catch 160 as the lever arm 140 is moved to the second position to pivot the releasable piston catch 160 out of engagement with the catch 162 on the piston stem 153 such that the piston 152 is released.

In a preferred arrangement where the toy projectile holder 130 includes a rotatable drum 131 as discussed above, preferably the arrangement includes an indexing mechanism 170 having a slidable indexing cam 171, similar to the indexing mechanism 70 and slidable indexing cam 71 discussed above. These interact with the first indexing spool 133 that is connected to the rotatable drum 131, with the first indexing spool 133 having a plurality of circumferentially spaced apart indexing drive surfaces 134. The slidable indexing cam 171 is releasably engageable with an indexing drive projection 172 on the piston stem 153 such that as the lever arm 140 is pivoted relative to the housing 120, from the first position to the second position, the indexing cam 171 is disengaged from a current one of the indexing drive surfaces 134 and, upon the piston stem 153 reaching a release position, the indexing cam 171 is biased back into engagement with the next one of the indexing drive surfaces 134. The release position is also defined here by a ramp surface 139 on the housing 120 that forces an indexing catch 175 (that is connected to the indexing cam 171) downward as the piston 152 is continued to be moved toward the cocking position such that the indexing cam 171 is released and is biased back into engagement with a next one of the indexing drive surfaces 134. The indexing catch 175 is preferably spring biased toward the engaged position.

In this embodiment of the toy projectile launcher 110, the optional second indexing spool 135 is also provided and is located axially behind the first indexing spool 133 such that the slidable indexing cam 171 engages with an indexing drive surface 136 on the second indexing spool 135 as the slidable indexing cam 171 is drawn backward by movement of the piston 152 via the lever arm 140. This provides two sets of indexing drive surfaces for rotating the rotatable drum 131 in order to ensure positional accuracy and positive drive and positioning of the rotatable drum 131 along the full rotational movement path.

Figure 15:
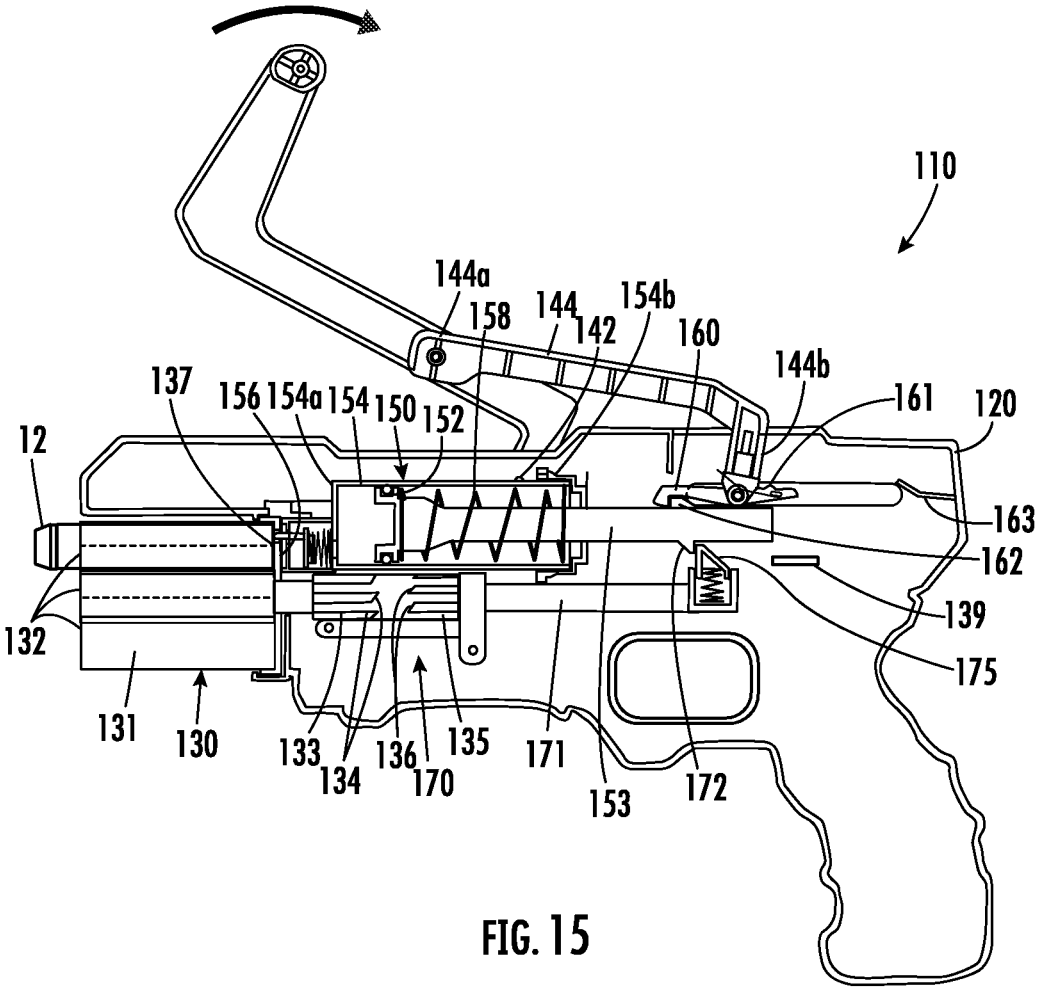

In order to launch a toy projectile from the toy launcher 110, a user grasps the drive lever 140 and pulls it backward as illustrated in FIG. 15. This results in the releasable piston catch 160 engaging with a catch 162 on the piston stem 153 and drawing the piston 152 backward toward a cocked position while at the same time the indexing mechanism 170 advances the rotatable drum 131 so that a next receiving space 132 is aligned with the compressed air delivery opening 156.

Figure 16:
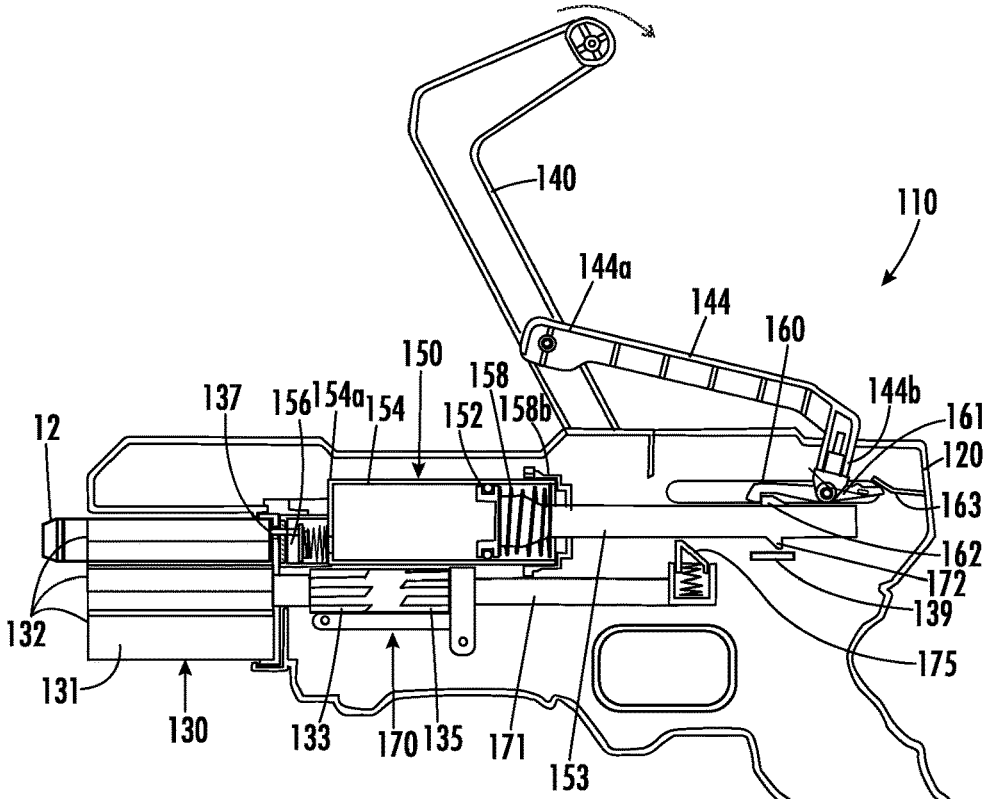

As shown in FIG. 16, as the drive lever 140 approaches the second position, the releasable piston catch 160 first contacts the release projection 161 on the housing which, as the lever arm 140 is moved to the fully cocked position, shown in FIG. 17, causes the releasable piston catch 160 to pivot and disengage from the catch 162 on the piston stem 153 such that the piston stem 153 is released and the piston 152 is biased forward via the biasing element 158 in order to delivery compressed air via the air delivery opening 156 to launch the toy projectile 12 from the toy projectile holder 130, which in the illustrated embodiment is one of the toy projectile receiving spaces 132 on the rotatable drum 131. Repeating the process in FIGS. 14-17 results in indexing of the rotatable drum 131 to advance the rotatable drum 131 to a next receiving space 132 and firing of projectiles 12 all based on moving the lever arm 140 between the first and second positions.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A toy launcher for launching projectiles, comprising:

a housing;

a toy projectile holder on or connected to the housing;

a lever arm extending outside of the housing and being connected for pivoting movement relative to the housing;

a trigger that is mounted for movement relative to the housing;

a piston and cylinder arrangement located in the housing, the piston being resiliently biased toward a first end of the cylinder by a biasing element, and the piston being moveable toward a second end of the cylinder to a cocked position by the lever arm being pivoted relative to the housing from a first position to a second position, a portion of the lever arm that extends outside the housing being adapted to be gripped or engaged by a user for pivoting the lever arm relative to the housing in order to move the piston from the first position to the second position;

the cylinder including a compressed air delivery opening at or connected to the first end that is configured to deliver compressed air from the cylinder to the toy projectile holder; and a releasable piston catch that is configured to hold the piston in the cocked position, the releasable piston catch being releasable upon the trigger being pulled such that the piston that is held in the cocked position is driven by the biasing element toward the first end of the cylinder to deliver compressed air via the air delivery opening to the toy projectile holder that is adapted to launch a toy projectile located in the toy projectile holder.

2. The toy launcher of claim 1, further comprising a drive arm having a first end pivotally connected to the lever arm and a second end connected to a piston stem that extends from the piston.

3. The toy launcher of claim 2, wherein the piston stem includes a longitudinally extending slot, and the second end of the drive arm is configured to engage against an end of the slot as the piston is moved toward the second end of the cylinder to the cocked position by the lever arm being pivoted relative to the housing from the first position to the second position.

4. The toy launcher of claim 3, wherein the second end of the drive arm is movable in the slot as the lever arm is pivoted relative to the housing from the second position back to the first position after the piston is moved to the cocked position.

5. The toy launcher of claim 2, wherein the releasable piston catch is configured to engage behind a ramp-shaped catch on the piston stem.

6. The toy launcher of claim 5, wherein the releasable piston catch is biased by an elastic element toward an engaged position toward the piston stem, and the ramp-shaped catch on the piston stem resiliently displaces the releasable piston catch as the piston is moved toward the second end of the cylinder to the cocked position by the lever arm being pivoted relative to the housing from the first position to the second position.

7. The toy launcher of claim 6, wherein the trigger includes a trigger ramp that is configured to displace the releasable piston catch against a force of the elastic element to a launching position in which the ramp-shaped catch on the piston stem is released upon the trigger being pulled such that the piston that is held in the cocked position is driven by the biasing element toward the first end of the cylinder.

8. The toy launcher of claim 2, further comprising a lever arm safety catch movably mounted to the housing that is biased toward the piston stem, and the piston stem further comprises a safety recess in which the lever arm safety catch engages when the piston is in the cocked position and the lever arm is not returned to the first position, and a lever arm safety release is connected to the second end of the drive arm which is configured to release the lever arm safety catch from the safety recess when the lever arm is returned to the first position.

9. The toy launcher of claim 2, further comprising the toy projectile holder including a rotatable drum having a plurality of toy projectile receiving spaces, and an indexing mechanism connected to the rotatable drum to advance the rotatable drum to a next receiving space as the lever arm is pivoted relative to the housing from the first position to the second position.

10. The toy launcher of claim 9, wherein the rotatable drum includes an indexing spool with a plurality of circumferentially spaced apart indexing drive surfaces, and the indexing mechanism includes a slidable indexing cam that is releasably engageable with an indexing drive projection on the piston stem such that as the lever arm is pivoted relative to the housing from the first position to the second position, the indexing cam is disengaged from a current one of the indexing drive surfaces, and upon the piston stem reaching a release position, the indexing cam is biased back into engagement with a next one of the drive surfaces.

11. A toy launcher for launching projectiles, comprising:

a housing;

a toy projectile holder on or connected to the housing;

a lever arm extending outside of the housing and being connected for pivoting movement relative to the housing;

a piston and cylinder arrangement located in the housing, the piston being resiliently biased toward a first end of the cylinder by a biasing element, and the piston being moveable toward a second end of the cylinder to a cocked position by the lever arm being pivoted relative to the housing from a first position to a second position, a portion of the lever arm that extends outside the housing being adapted to be gripped or engaged by a user for pivoting the lever arm relative to the housing in order to move the piston from the first position to the second position;

the cylinder including a compressed air delivery opening at or connected to the first end that is configured to deliver compressed air from the cylinder to the toy projectile holder; and a releasable piston catch that is driven by the lever arm and is configured to draw the piston to the cocked position, and the releasable piston catch being releasable upon or after the lever arm being pulled to the second position such that the piston is released and is driven by the biasing element toward the first end of the cylinder to deliver compressed air via the air delivery opening to the toy projectile holder that is adapted to launch a toy projectile located in the toy projectile holder.

12. The toy launcher of claim 11, further comprising a drive arm having a first end pivotally connected to the lever arm and a second end to which the releasable piston catch is connected.

13. The toy launcher of claim 12, wherein the releasable piston catch is pivotally mounted to the second end of the drive arm and is biased into engagement with a catch on a piston stem that extends from the piston.

14. The toy launcher of claim 13, further comprising a release projection that is connected to the housing that is arranged to contact the releasable piston catch as the lever arm is moved to the second position to pivot the releasable piston catch out of engagement with the catch on the piston stem such that the piston is released.

15. The toy launcher of claim 12, further comprising the toy projectile holder including a rotatable drum having a plurality of toy projectile receiving spaces, and an indexing mechanism connected to the rotatable drum to advance the rotatable drum to a next receiving space as the lever arm is pivoted relative to the housing from the first position to the second position.

16. The toy launcher of claim 15, wherein the rotatable drum includes an indexing spool with a plurality of circumferentially spaced apart indexing drive surfaces, and the indexing mechanism includes a slidable indexing cam that is releasably engageable with an indexing drive projection on the piston stem such that as the lever arm is pivoted relative to the housing from the first position to the second position, the indexing cam is disengaged from a current one of the indexing drive surfaces, and upon the piston stem reaching a release position, the indexing cam is biased back into engagement with a next one of the drive surfaces.

* * * * *